US005275235A

United States Patent [19]

Cesaroni

[11] Patent Number: 5,275,235

[45] Date of Patent: Jan. 4, 1994

[54] PANEL HEAT EXCHANGER

[76] Inventor: Anthony J. Cesaroni, 9 Heathmore Court, Unionville, Ontario, Canada, L3R 8J1

[21] Appl. No.: 745,455

[22] Filed: Aug. 14, 1991

Related U.S. Application Data

[63] Continuation of Ser. No. 545,086, Jun. 28, 1990, abandoned.

[30] Foreign Application Priority Data

Jul. 28, 1989 [GB] United Kingdom ..... 8917240

[51] Int. Cl.[5] ..... F28F 3/12

[52] U.S. Cl. ..... 165/170; 165/167

[58] Field of Search ..... 165/167, 170; 29/890.039; 126/449

[56] References Cited

U.S. PATENT DOCUMENTS

| | | | |
|---|---|---|---|
| 1,974,665 | 9/1934 | Schnetzer et al. | 165/170 |
| 2,616,671 | 11/1952 | Wakeman | 165/167 |
| 3,157,229 | 11/1964 | Wennerberg | 165/167 |
| 3,327,776 | 6/1967 | Butt | 165/170 |
| 3,528,496 | 9/1970 | Kun | 165/166 |
| 4,287,883 | 9/1981 | Kyrias | 165/170 |
| 4,289,117 | 9/1981 | Butcher | 126/449 |
| 4,398,596 | 8/1983 | Lauro et al. | 165/167 |
| 4,524,757 | 6/1985 | Buckley | 165/46 |
| 4,955,435 | 9/1990 | Shuster et al. | 165/170 |

FOREIGN PATENT DOCUMENTS

| | | | |
|---|---|---|---|
| 13997 | 1/1987 | Japan | 165/170 |

*Primary Examiner*—John Rivell
*Assistant Examiner*—L. R. Leo

[57] ABSTRACT

A panel heat exchanger formed from thermoplastic polymer compositions and having a mesh structure between outer walls of the heat exchanger is disclosed. The thermoplastic polymer of the sheet is preferably polyamide. The mesh structure may be in the form of a perforated corrugated sheet that is preferably also formed from a thermoplastic polymer, especially a polyamide. A method for the manufacture of the panel heat exchangers is also disclosed. The panel heat exchangers may be used in a wide variety of end-uses, including automotive end-uses e.g. in the cooling of transmission oil.

5 Claims, 3 Drawing Sheets

PANEL HEAT EXCHANGER

This is a continuation of application Ser. No. 07/545,086, filed Jun. 28, 1990 now abandoned.

The present invention relates to a panel heat exchanger formed from thermoplastic polymer compositions and to the manufacture of such heat exchangers, and especially to such heat exchangers having a self-supporting mesh structure e.g. a perforated corrugated sheet, between layers of sheet that form the outer walls of the heat exchanger. Preferably, all of the heat exchanger is formed from thermoplastic polymer compositions.

Plate or panel heat exchangers manufactured from thermoplastic polymers, and methods for the manufacture of such heat exchangers, are disclosed in published European patent applications Nos. 0 286 399 and 0 286 400, of A. J. Cesaroni and J. P. Shuster, both published Oct. 12, 1988, in published European patent application No. 0 304 261 of A. J. Cesaroni, published Feb. 22, 1989, in published European patent application No. 0 337 802 of A. J. Cesaroni and J. P. Shuster, published Oct. 18, 1989, and in U.K. patent application No. 89/010966 of E. L. Fletcher, filed May 12, 1989. In particular, the applications disclose panel heat exchangers formed from compositions of polyamides.

Polyamides offer a number of advantages as the material of construction of thermoplastic panel heat exchangers. In particular, polyamides may provide sufficient strength, toughness and chemical resistance properties at elevated temperatures to enable panel heat exchangers formed from polyamides to be used in such demanding applications as oil coolers in automotive end-uses. Oil coolers may be exposed to the atmosphere, in which event the heat exchanger is exposed to environmental conditions including stones, grit and the like associated with use of an automobile, or the oil cooler may be located within the radiator of the automobile, in which event the exterior of the oil cooler is exposed to water, glycols and other additives in the liquid of the radiator cooling system.

There are, however, difficulties in the fabrication of panel heat exchangers from polyamides in an efficient manner, especially with respect to the forming of fluid passages and other sections of the panel heat exchanger and to the bonding together of the parts of the heat exchanger.

An improved panel heat exchanger formed from thermoplastic polymer compositions and containing a self-supporting mesh structure having fluid flow passages therein, and methods of manufacture thereof, have now been found.

Accordingly, the present invention provides a panel heat exchanger comprising a panel having unitary outer walls defining inlet and outlet header areas in a spaced apart relationship and fluid flow passages therebetween, said walls being of a thickness in the range of about 0.07 to 0.7 mm and formed from a composition of a thermoplastic polymer, the outer walls being bonded to opposite sides of a self-supporting mesh structure having fluid flow passages therein that is located between the inlet and outlet header areas, the inlet and outlet header areas being in fluid flow communication.

In a preferred embodiment of the panel heat exchanger of the present invention, the self-supporting mesh structure is a corrugated sheet formed from thermoplastic polymer, especially polyamide, said sheet having a plurality of fluid flow passages through opposing slopes of each corrugation thereof.

In another embodiment, the fluid flow passages of the corrugated sheet are staggered in an axial direction between said inlet and outlet header areas.

In a further embodiment, the fluid flow passages on each slope of each corrugation are staggered relative to the passages on the adjacent corrugation.

In yet another embodiment, the corrugated sheet has a plurality of corrugations having openings defining fluid flow passages on both slopes of each corrugation, the passages being defined by a plurality of slits in side-by-side arrangement with relative displacement of regions of the thermoplastic polymer defined by successive slits so as to form said fluid flow passages.

In another embodiment, the inlet and outlet header areas contain inlet and outlet distribution rings, respectively.

In yet another embodiment, the corrugated sheet and/or panel is formed from a polyamide composition.

In still another embodiment, the panel heat exchanger is formed from two sheets of the thermoplastic polymer, which are bonded peripherally in a fluid tight manner.

The present invention also provides a process for the manufacture of a panel heat exchanger comprising a panel having a pair of unitary outer walls defining inlet and outlet header areas in a spaced apart relationship and fluid flow passages therebetween, said walls being formed from a composition of a thermoplastic polymer and having a thickness in the range of 0.07 to 0.7 mm, said process comprising the steps of:

(a) placing a sheet of thermoplastic polymer having orifices corresponding to inlet and outlet means onto one half of a mould having male locating means corresponding to the locations of said orifices;

(b) placing an inlet distribution ring over one male locating means and an outlet distribution ring over the other male locating means;

(c) placing a strip of self-supporting mesh structure on the sheet between the inlet and outlet distribution rings;

(d) placing a second sheet of thermoplastic polymer composition having orifices corresponding to the inlet and outlet header means over said male locating means;

(e) placing a second half of the mould over said second sheet and inlet and outlet distribution rings, said second half having female locating means cooperatively located with respect to the male locating means of the first half of the mould; and (f) applying heat and pressure to effect bonding of the sheets of thermoplastic polymer composition to opposite sides of the self-supporting mesh and to peripherally bond the sheets of thermoplastic polymer together; the panel heat exchanger so formed having the inlet and outlet header areas in fluid flow communication.

In a preferred embodiment of the process of the present invention, the self-supporting mesh is in the form of corrugated sheet having a plurality of fluid flow passages through opposing slopes of each corrugation, and especially having such fluid flow passages staggered in an axial direction between said inlet and outlet distribution rings of the panel heat exchanger.

In another embodiment, the thermoplastic polymer is polyamide, and each surface of the polyamide sheets in contact with the mesh, optionally in the form of corrugated sheet, is coated with a material that facilitates bonding of the polyamide sheets to the mesh and to each other.

In yet another embodiment, an inert gas, especially nitrogen, is purged through the heat exchanger between the inlet and outlet header means during step (f).

In a further embodiment, the sheets are preformed to the shape of the panel heat exchanger.

In a still further embodiment, the corrugated sheet is formed from a thermoplastic polymer, especially a polyamide.

The present invention relates to a panel heat exchanger formed from a thermoplastic polymer composition, and to the manufacture thereof, and especially to such a heat exchanger in which the thermoplastic polymer is polyamide. The invention will be particularly described with reference to the embodiments shown in the drawings, and especially to use of polyamide as the thermoplastic polymer and corrugated sheet as the self-supporting mesh structure, in which.

The drawings show an embodiment of a panel heat exchanger that is elongated and substantially planar. It is to be understood, however, that the panel heat exchanger may be of other shapes e.g. formed from sheets that are not elongated, which have sides that are not parallel to each other and/or which are not substantially planar i.e. are curved.

Figure 1:
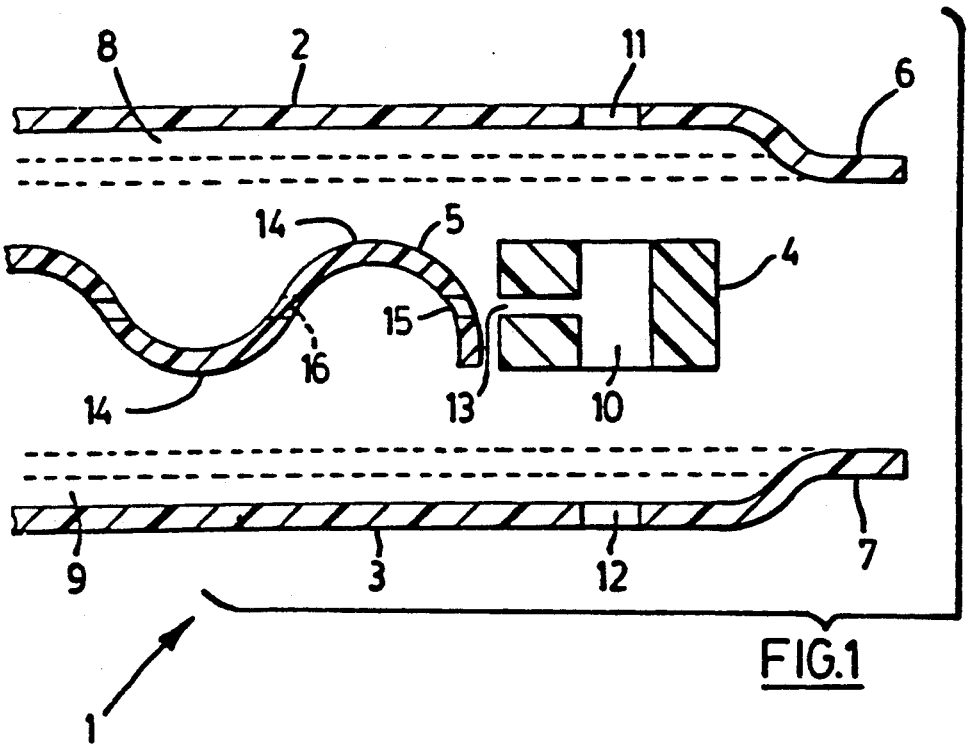
FIG. 1 is an exploded view of an end section of an embodiment of a panel heat exchanger of the invention.

In the embodiment shown in FIG. 1, the panel heat exchanger, generally indicated by 1 and only one end of which is shown, is comprised of two sheets 2 and 3 formed from a polyamide composition, a distribution ring 4 and a self-supporting mesh structure, which is shown to be in the form of corrugated sheet 5; distribution ring 4 is not essential to the panel heat exchanger, but it is preferred that the heat exchanger have distribution rings. Distribution ring 4 and corrugated sheet 5 are each located between the polyamide sheets 2 and 3. Polyamide sheets 2 and 3 have edges 6 and 7, respectively, that in the assembled panel heat exchanger are sealed together to form the peripheral seal of the heat exchanger. Each of polyamide sheets 2 and 3 has a portion 8 and 9, respectively, that accommodates the distribution ring 4 and corrugated sheet 5; while polyamide sheets 2 and 3 are generally planar, they are preferably preformed to the shape required to accommodate the distribution rings and corrugated sheet.

Figure 2A:
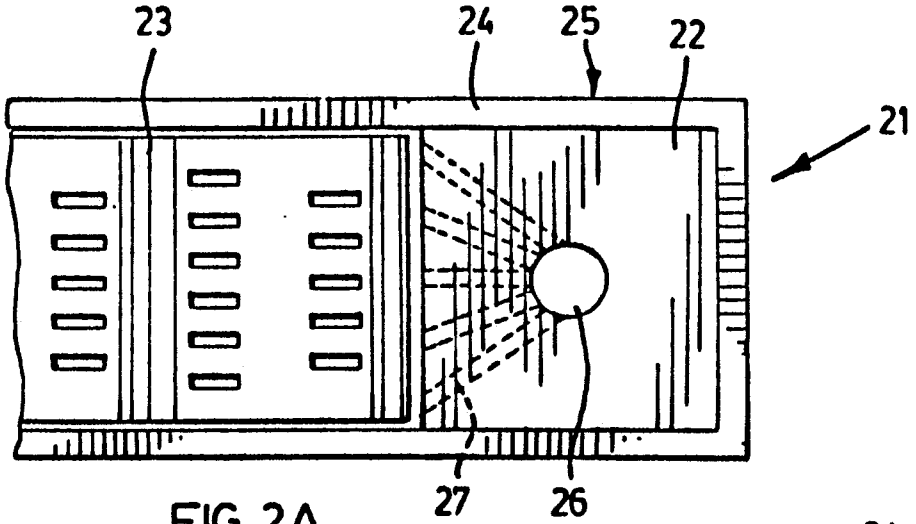
FIGS. 2A and 2B are plan views of end sections of embodiments of a panel heat exchanger of FIG. 1.

Distribution ring 4 has an axially or centrally located orifice 10 that is aligned with orifices 11 and 12 in polyamide sheets 2 and 3, to thereby form a fluid flow passage into or out of the distribution ring 4 from exterior to the panel heat exchanger. In addition, distribution ring 4 has a channel 13 extending from orifice 10 to the region of corrugated sheet 5. In practice, distribution ring 4 may have a plurality of channels 13 and in some embodiments discussed hereinafter e.g. the embodiment of FIG. 2B, may extend from orifice 10 in a number of directions that may at 180° to each other; however, the embodiment of FIG. 2A is preferred. Channel 13 could be substantially tubular in cross-section but, especially if only one channel is used, could be fan-shaped with the outer section of the fan extending over a substantial portion of the width of the panel heat exchanger.

Corrugated sheet 5 has a plurality of corrugations 14, parts of two of which are shown. Each corrugation has a plurality of passages 15 and 16 therethrough, which are not aligned with respect to the longitudinal direction between the inlet and outlet of the heat exchanger. Passages 15 and 16 are located on the slopes of the corrugations, passages being required on each slope in order that the inlet and outlet will be in fluid flow communication. A preferred embodiment of the corrugated sheet is described in the patent application of A. J. Cesaroni filed concurrently herewith.

Figure 2B:
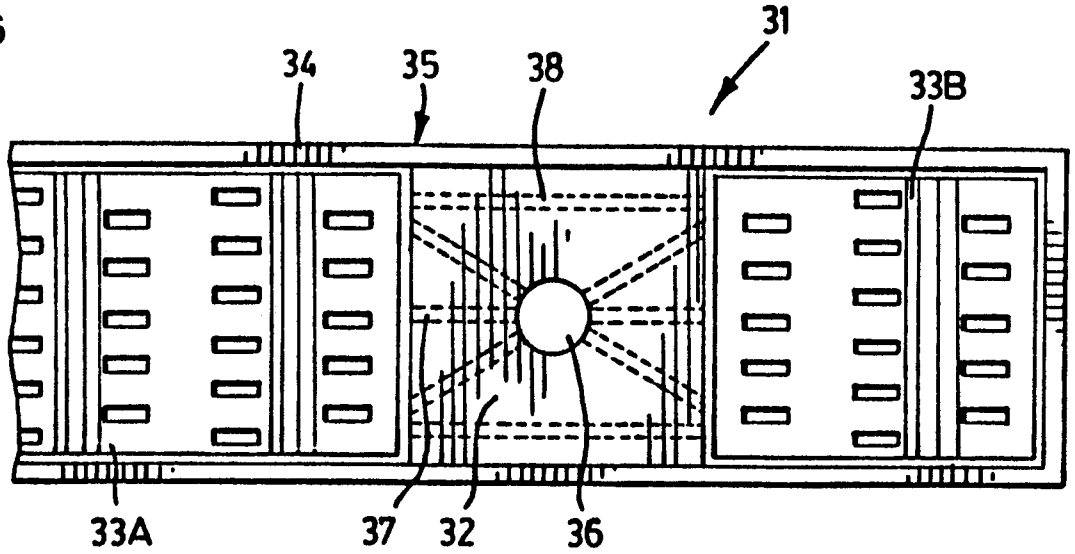

FIGS. 2A and 2B show plan views of the panel heat exchanger, with the top sheet having been omitted for clarity. In the more preferred embodiment of FIG. 2A, the panel heat exchanger, generally indicated by 21, has a distribution ring 22 in a juxtaposed relationship with corrugated sheet 23. Distribution ring 22 and corrugated sheet 23 are contained between a first (lower) polyamide sheet 24 and a second (upper) polyamide sheet (not shown). The first and second polyamide sheets are peripherally sealed to form the outer perimeter of the panel heat exchanger. Distribution ring 22 has a axially located orifice 26 from which a plurality of channels 27 pass to the exterior of the distribution ring 22 to form fluid flow passages between orifice 26 and region of corrugated sheet 23 within panel heat exchanger 21.

In the embodiment of FIG. 2B, the panel heat exchanger, generally indicated by 31, has a distribution ring 32 in a juxtaposed relationship with corrugated sheet 33, shown as 33A and 33B. Distribution ring 32 and corrugated sheet 33 are contained between two polyamide sheets, only the lower of which (34) is shown for clarity. The polyamide sheets are peripherally sealed to form the outer perimeter of the panel heat exchanger. Distribution ring 32 has an axially located orifice 36 from which a plurality of channels 37 pass to the exterior of the distribution ring 32 to form fluid flow passages between orifice 36 and the region of corrugated sheet 33. The panel heat exchanger of FIG. 2B differs from the more preferred embodiment of FIG. 2A in that corrugated sheet 33 is located on both sides of distribution ring 32. Channels 37 pass through the distribution ring from orifice 26 to the regions of the corrugated sheet 33A and 33B. In addition, distribution ring 36 has channels 38 that pass directly from the region of corrugated sheet 33A to the region of corruguated sheet 33B, by-passing orifice 36.

The embodiment of FIG. 2B is intended for use where the location of orifice 36 within the panel heat exchanger is fixed or predetermined for reasons unrelated to the manufacture of the panel heat exchanger but where the possibility exists for extensions to the area of heat exchange beyond the section between the inlet and outlet. For example the specification for a panel heat exchanger required by an automobile company will likely specify the distance between orifices in the panel heat exchanger but the location of the panel heat exchanger in use may offer an opportunity to have an extended region for transfer of heat, and regions corresponding to corrugated sheet 33A and 33B could be used.

Figure 3:
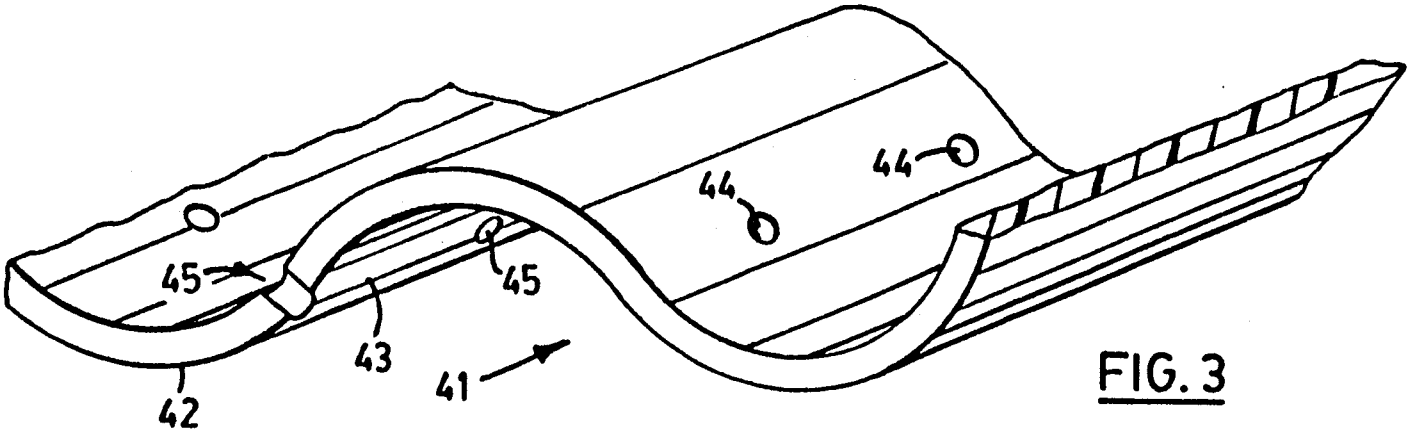
FIG. 3 is a schematic representation of a section of corrugated sheet used in the panel heat exchanger of FIG. 1.

In FIG. 3, corrugated sheet is generally indicated by 41 and is shown in a side elevation. The sheet 42 has a plurality of corrugations, one of which is shown, 43. The slopes on both sides of the corrugation contain orifices 44 and 45. Orifices 44 and 45 are in a non-aligned position when viewed at right angles to the corrugation i.e. non-aligned with respect to the axis between the inlet and outlet header areas. The orifices 44 and 45 may be of any convenient shape including circular and rectangular; an important factor in determining the particular shape of the orifices 44 and 45 will be the ease of manufacture of the corrugated sheet. The orifices will be of a size and shape that permit flow of fluid, the non-aligned aspect being intended to cause turbulence in and mixing of fluid flowing through the heat exchanger and hence result in more effective heat transfer. As noted above, a preferred embodiment of the corrugated sheet, including manufacture thereof, is described in the patent application filed concurrently herewith.

Figure 4:
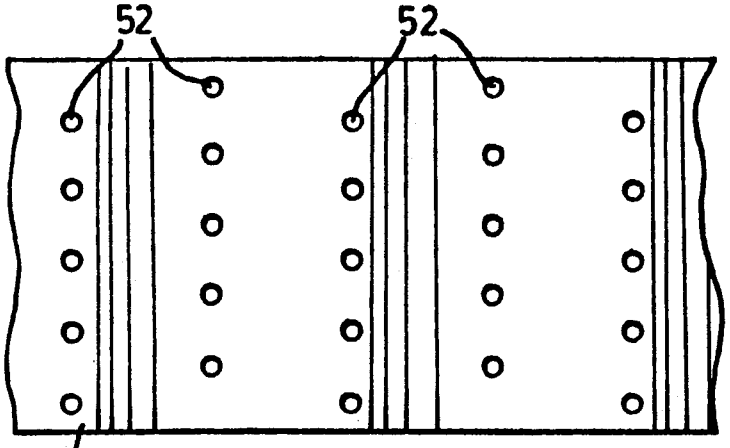

FIG. 4 shows a corrugated sheet 51 in plan view. Sheet 51 has a plurality of orifices 52 that are in an aligned position when viewed in a transverse direction across the sheet but in a non-aligned position when viewed in the direction of the length of the sheet i.e. the axis between the inlet and outlet header areas. The orifices shown in FIG. 4 are circular.

Figure 5:
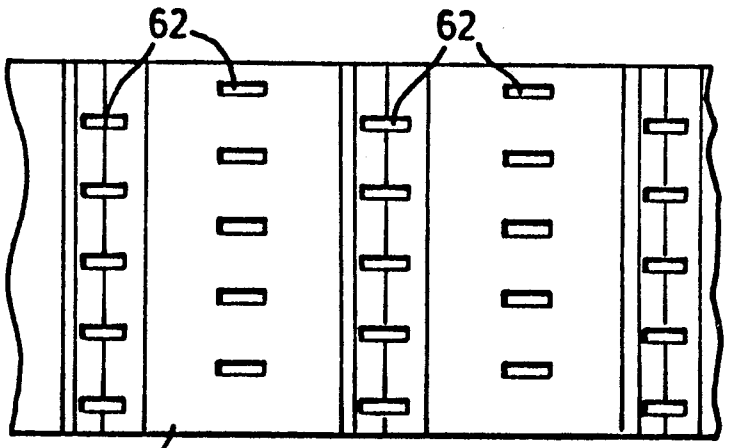
FIGS. 4 and 5 are schematic representations of plan views of embodiments of the corrugated sheet of FIG. 3.

FIG. 5 shows a corrugated sheet 61 in plan view. Sheet 61 has a plurality of orifices 62 that are in an aligned position when viewed in a transverse direction across the sheet but in a non-aligned position when viewed in the direction of the length of the sheet. The orifices shown in FIG. 5 are rectangular.

The panel beat exchanger of the present invention may be assembled with or without the use of gaskets or the like, depending in particular on the operating requirements for the heat exchanger.

The invention has been described above with reference to a single panel heat exchanger. However, a plurality of heat exchangers may be used, the heat exchangers being arranged in series or more likely in parallel. It may be preferable to use spacers between the individual panel heat exchangers of a stack of heat exchangers.

In a preferred embodiment of the process of the present invention, each sheet used in the fabrication of the heat exchanger is coated with a coating composition to facilitate bonding to the corrugated sheet, in the peripheral bonding to each other and/or bonding to end faces of any distribution ring. Depending on operating requirements, bonding agents will likely be needed to obtain bonds of adequate strength, especially for the peripheral bond. Examples of such coatings are disclosed below, as well as in the aforementioned published European patent applications of A. J. Cesaroni and J. P. Shuster.

In the fabrication of the heat exchanger, a first sheet of the polymer composition, normally preformed to the shape of the panel heat exchanger to be fabricated, is placed on one half of a mould having male locating means that correspond to the inlet and outlet orifices of the panel heat exchanger. The male locating means may also have fluid e.g. air or nitrogen, dispensing means e.g. an orifice, and fluid receiving means, respectively, to for example permit purging of gases from within the panel heat exchanger during or after fabrication. An inlet distribution ring is then preferably placed over one male locating means and an outlet distribution ring over the other. The end faces of the distribution ring will normally be coated with a coating composition to facilitate bonding of the distribution ring to the sheets of the heat exchanger, especially if the polymer is a polyamide. A strip of corrugated sheet, as described above, is then placed on the first sheet, between the distribution rings; in embodiments in which the heat exchanger also has corrugated sheet in areas opposite the intervening areas between the distribution rings, then corrugated sheet would also be placed in such areas. A second sheet of the polymer composition is then placed over the corrugated sheet, the second being complementary and in embodiments identical to the first sheet. The second half of the mould is then added, the second half having female locating means corresponding to the male locating means of the first half of the mould. Heat and pressure are then applied to effect bonding between the sheets and corrugated sheet, and to effect peripheral bonding between the first and second sheets. Bonds may also be formed with the distribution rings, especially the end faces of the distribution rings. A fluid tight seal is required for the peripheral bond; the other bonds may have less stringent requirements. The edges of the heat exchanger may need to be trimmed.

In an embodiment of the process, the temperature of the fabricated panel heat exchanger is increased to above the expected operating temperature of the resultant heat exchanger prior to removal of the panel heat exchanger from the mould, in order to reduce distortion of the heat exchanger during subsequent use.

It is disclosed herein that the bonding of the sheets is conducted under the influence of heat and pressure. It should be understood that the bonding cycle of the process may be conducted only in part under the influence of heat and pressure, and that the pressure may be a relatively low pressure.

Any coating applied to the sheets, and to the distribution rings, should be a coating that promotes bonding between the polymer compositions of the sheets, which will normally be the same polymer. Such coatings are known and include a wide variety of adhesives. Examples are discussed in the aforementioned published European patent applications e.g. a homogeneous admixture of benzyl alcohol, phenol and polyamide may be used in the bonding of polyamide compositions.

The sheets may be formed from a variety of polyamide compositions. The composition selected will depend primarily on the end use intended for the heat exchanger, especially the temperature of use and the environment of use, including the fluid that will be passed through the heat exchanger and the fluid e.g. air, external to the heat exchanger. In the case of use on a vehicle, the fluid may be air that at times contains salt or other corrosive or abrasive matter, or the fluid may be liquid e.g. radiator fluid.

Examples of polyamides are the polyamides formed by the condensation polymerization of an aliphatic dicarboxylic acid having 6–12 carbon atoms with an aliphatic primary diamine having 6–12 carbon atoms. Alternatively, the polyamide may be formed by condensation polymerization of an aliphatic lactam or alpha, omega aminocarboxylic acid having 6–12 carbon atoms. In addition, the polyamide may be formed by copolymerization of mixtures of such dicarboxylic acids, diamines, lactams and aminocarboxylic acids. Examples of dicarboxylic acids are 1,6-hexanedioic acid (adipic acid), 1,7-heptanedioic acid (pimelic acid), 1,8-octanedioic acid (suberic acid), 1,9-nonanedioic acid (azelaic acid), 1,10-decanedioic acid (sebacic acid) and 1,12-dodecanedioic acid. Examples of diamines are 1,6-hexamethylene diamine, 1,8-octamethylene diamine, 1,10-decamethylene diamine and 1,12-dodecamethylene diamine. An example of a lactam is caprolactam. Examples of alpha,omega aminocarboxylic acids are amino octanoic acid, amino decanoic acid and amino dodecanoic acid. Preferred examples of the polyamides are polyhexamethylene adipamide and polycaprolactam, which are also known as nylon 66 and nylon 6, respectively.

The panels and sheet of the present invention have been described with particular reference to the use of polyamides as the polymer used in the fabrication thereof. It is to be understood, however, that other polymers may be used, the principal consideration being the environment of use of the panel heat exchanger e.g. the properties of the fluid passing through and over the panel heat exchanger, the temperature and pressure of use and the like. Examples of other thermoplastic polymers that may be used are polyethylene, polypropylene, fluorocarbon polymers, polyesters, thermoplastic and thermoset elastomers e.g. polyetherester elastomers, neoprene, chlorosulphonated polyethylene, and ethylene/propylene/diene (EPDM) elastomers, polyvinyl chloride and polyurethane.

In preferred embodiments of the present invention, the sheets used in the fabrication of the panel heat exchanger have thicknesses of less than 0.7 mm, and especially in the range of 0.07–0.50 mm, particularly 0.12–0.30 mm. The thickness of the sheet will, however, depend to a significant extent on the proposed end use and especially the properties required for that end use.

The polymer compositions used in the fabrication of the panel heat exchangers may contain stabilizers, pigments, fillers, including glass fibres, and the like, as will be appreciated by those skilled in the art.

The polymer composition of the distribution ring and of the corrugated sheet may be similar to or the same as that of the panels, although different polymers may be used. Nonetheless, in preferred embodiments the distribution ring is fabricated from a so-called engineering polymer, especially a polyamide of the type discussed above.

While the invention has been described herein with reference to the bonding of the end faces of the distribution ring to the panels, it is not essential that this occur. In an alternative, a fluid-tight seal may be obtained between the distribution ring and the panel by other means e.g. the pressure exerted by header means attached to the panel heat exchanger at the inlet or outlet, to the extent that the resultant heat exchanger is useful for many end-uses.

Laminated or coated materials may be utilized in the fabrication of the panel heat exchanger. Such materials could Comprise a layer providing the necessary physical resistance and inner and/or outer layers to provide resistance to the working fluids or contaminants. Wire mesh or metal foil may be incorporated into the sheets or as a separate layer between the polyamide sheets and the corrugated sheet, both to improve physical properties e.g. burst strength, but also to improve conduction of heat through the sheet. Glass fabric may be incorporated into the polyamide sheets to improve strength properties of the sheets. Microturbulence may also be generated on the surface of the sheet by provision of protuberances, pebbling or other surface effects.

In operation, a fluid that is to be heated or cooled would enter the panel heat exchanger through the orifice at the inlet header, pass through the inlet distribution ring and then enter the fluid flow channels between the inlet and outlet headers. The channels are comprised of the corrugated sheet, which serves to mix the fluid passing through and cause turbulence in that fluid. The fluid would then enter the outlet distribution ring and pass from the panel heat exchanger. Such admixing would have beneficial effects, including reduction of streaming of the fluid between the inlet and outlet, and hence improve the effectiveness of the heat exchanger. A second fluid having a temperature different from that of the fluid passed through the panel of the panel heat exchanger would be passed over the surface of the panel heat exchanger.

In cold weather, especially below about −15° C., oil tends to become very viscous. On starting a motor under such conditions, the oil pressure obtained may be substantially above normal operating pressures. In order to reduce the possibility of damage to a panel heat exchanger under such circumstances, the heat exchanger may be equipped with a by-pass system so that cold viscous oil passes from the inlet to the outlet without passing through the fluid flow channels. This may be accomplished using a heat activated by-pass valve to pass cold oil through alternate passages that go directly from inlet to outlet until such time as the oil reaches a predetermined temperature at which time the valve would direct the oil through the fluid flow channels of the heat exchanger.

The process of the present invention provides a versatile and relatively simple method of fabricating heat exchangers that obviates potential process problems associated with the melting characteristics of some polymers, especially polyamides. Simple moulds and fabrication techniques are used.

The heat exchangers may be used in a variety of end uses, depending on the polymer from which the heat exchanger has been fabricated and the intended environment of use of the heat exchanger. In embodiments, the panel heat exchangers may be used in automotive end uses e.g. as part of the water and oil cooling systems.

The present invention is illustrated by the following examples.

EXAMPLE I

A two-part mould was machined from aluminum, the first or lower part having a thickness of 2.54 cm and the second or top part having a thickness of 0.94 cm. An elongated mould cavity was machined in each part of the mould, in the shape of the embodiment of the heat exchanger illustrated in FIG. 2A; each cavity had a length of approximately 40 cm and a depth of approximately 0.15 mm. The male locating means of the first part of the mould were located approximately 29 cm apart, between centres, and had a diameter of 2.2 cm. The male locating means were adapted for injection of gas through one and purging out through the other.

The first part of the mould was placed in a press followed by two sheets of polyamide, each having orifices corresponding to the male locating means and a thickness of 0.375 mm and formed from a melt blend of Zytel® HSB high molecular weight polyamide and CFE 8008 melt-strength enhanced polyamide available from Du Pont Canada Inc. in a ratio by weight of 1:1 that contained 9% by weight of glass fibre, followed by the second part of the mould. The press was closed and the mould was heated to a temperature of about 120° C.; a pressure of 1.05 mPa was applied using nitrogen. After about 30 seconds, the mould was re-opened. The sheets had been formed to the shape of the mould but not bonded together.

Using the parts of the mould described above, the first part was placed in a press followed by the corresponding pre-moulded sheet of polyamide. Distribution rings were then placed over the male locating rings. Pieces of corrugated polyamide sheet corresponding to the shape of the cavity of the mould were placed between the distribution rings; the corrugated sheet was as described in FIGS. 3 and 4. The second pre-moulded sheet of polyamide and then the second half of the mould were placed on top. Both pieces of polyamide sheet and the corrugated sheet had been coated with a mixture of phenol (80%), benzyl alcohol (12%) and methanol (8%) to promote adhesion in the areas to be bonded.

The press was closed and a pressure of 5.9 mPa was applied at a mould temperature of about 177° C.; nitrogen was applied to the mould at a pressure of about 1.7 mPa. After about three minutes, the moulded panel heat exchanger was removed from the mould and trimmed around the edges.

EXAMPLE II

The procedure of Example I was repeated, except that the moulds were adapted for the manufacture of heat exchangers of the shape shown in FIG. 2B. The sheet used was formed from a nylon 66 polymer composition.

A heat exchanger was formed.

EXAMPLE III

The procedure of Example I was repeated using each of the following sheets:

(a) sheet formed from a melt blend of CFE 8008 and CFE 8004 melt enhanced polyamides in a ratio of 1:1 by weight, containing 9% by weight of glass fibres;

(b) sheet formed from 105 mesh stainless steel screen having a thickness of 0.15 mm laminated between two films of nylon 66 having thicknesses of 0.10 mm;

(c) sheet formed from 20 mesh aluminum screen having a thickness of 0.20 mm laminated on one side (outside) with sheet as described in Example I having a thickness of 0.254 mm;

(d) sheet formed from woven glass cloth having a thickness of 0.127 mm laminated between two films of nylon 66 having thicknesses of 0.0762 mm.

In each instance, panel heat exchangers were formed.

EXAMPLE IV

The procedure of Example I was repeated, except that,aluminum screens were placed between the polyamide sheets and the corrugated sheet. The aluminum screens had a thickness of 0.16 mm and had been formed by compressing commercial-grade aluminum screen having a thickness of 0.5 mm.

A panel heat exchanger was formed.

I claim:

1. A panel heat exchanger comprising a panel having unitary outer walls defining inlet and outlet header areas in a spaced apart relationship and fluid flow passages therebetween, said outer walls having a thickness in the range of about 0.07 to 0.7 mm and being formed from two sheets of thermoplastic polyamide which are bonded peripherally in a fluid tight manner, the outer walls being bonded to opposite sides of a self-supporting mesh structure having fluid flow passages therein that is located between the inlet and outlet header areas and being a corrugated sheet formed from thermoplastic polyamide said sheet having a plurality of fluid flow passages through opposing slopes of each corrugation.

2. The panel heat exchanger of claim 1 in which the fluid flow passages of the corrugated sheet are staggered in an axial direction between said inlet and outlet areas.

3. The panel heat exchanger of claim 1 in which the fluid flow passages on each slope of each corrugation are staggered relative to the passages on the adjacent corrugation.

4. The panel heat exchanger of claim 1 in which the corrugated sheet has a plurality of corrugations having openings defining fluid flow passages on both slopes of each corrugation, the passages being defined by a plurality of slits in side-by-side arrangement with relative displacement of regions of the thermoplastic polymer defined by successive slits so as to form said fluid flow passages.

5. The panel heat exchanger of claim 1 in which the self-supporting mesh structure is formed from a polyamide composition.

* * * * *